US011557855B2

(12) United States Patent
Geng et al.

(10) Patent No.: US 11,557,855 B2
(45) Date of Patent: Jan. 17, 2023

(54) LOW PROFILE ANGLED CONNECTOR

(71) Applicant: TE Connectivity Services GmbH, Schaffhausen (CH)

(72) Inventors: Xiaobao Geng, Troy, MI (US); Weiping Zhao (George), Troy, MI (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/246,879

(22) Filed: May 3, 2021

(65) Prior Publication Data

US 2022/0352674 A1 Nov. 3, 2022

(51) Int. Cl.

| | |
|---|---|
| ***H01R 13/627*** | (2006.01) |
| ***H01R 13/40*** | (2006.01) |
| ***H01R 13/502*** | (2006.01) |
| ***H01R 13/629*** | (2006.01) |
| *H01R 13/64* | (2006.01) |

(52) U.S. Cl.

CPC ..... *H01R 13/6271* (2013.01); *H01R 13/40* (2013.01); *H01R 13/502* (2013.01); *H01R 13/629* (2013.01); *H01R 13/64* (2013.01)

(58) Field of Classification Search

CPC .. H01R 13/6271; H01R 13/40; H01R 13/502; H01R 13/629; H01R 13/64

See application file for complete search history.

(56) References Cited

U.S. PATENT DOCUMENTS

| | | | | |
|---|---|---|---|---|
| 5,015,200 | A * | 5/1991 | Abernethy | H01R 13/6271 439/357 |
| 10,290,972 | B2 * | 5/2019 | Gunreben | H01R 13/639 |
| 11,285,832 | B2 * | 3/2022 | Rhodes | B60L 53/302 |
| 11,336,051 | B1 * | 5/2022 | Tyler | H01R 13/5202 |
| 2014/0193990 | A1 * | 7/2014 | Zhao | H01R 13/713 439/160 |
| 2018/0316130 | A1 * | 11/2018 | Gunreben | H01R 13/639 |
| 2019/0190185 | A1 * | 6/2019 | Mori | H01R 13/6581 |
| 2019/0190192 | A1 * | 6/2019 | Mori | H01R 13/621 |
| 2022/0102879 | A1 * | 3/2022 | Kim | H01M 50/296 |

* cited by examiner

*Primary Examiner* — Abdullah A Riyami
*Assistant Examiner* — Nader J Alhawamdeh

(57) ABSTRACT

An electrical connector assembly having a first electrical connector or header including a base and a shroud extending therefrom. The shroud defines a first opening arranged opposite the base and a second lateral opening defined between two ends thereof. A second or mating connector of the assembly includes a mating end received within the first opening of the shroud in an insertion direction. A body of the second electrical connector is received within the second lateral opening of the shroud and includes a pair of covers or hoods with channels for receiving and mechanically joining the two ends of the shroud.

20 Claims, 3 Drawing Sheets

LOW PROFILE ANGLED CONNECTOR

FIELD OF THE INVENTION

The present disclosure relates to electrical connectors, and more particularly, to a low profile electrical header and complementary mating connector.

BACKGROUND

Electronic components are often housed or packaged separately from a remainder of a larger electrical system in which they are utilized, promoting ease of integration and improved protection of sensitive components from harsh environmental conditions. As a result, the components must be electrically interconnected with other elements of the system. These connections are often implemented via wires or cables joining various components using complementary electrical connectors or connector assemblies, including device-mounted headers. Headers and associated mating connectors may be directional in nature, or configured to connect to a corresponding mating electrical connector such that an angular conducive pathway is realized (e.g., a right-angle or 90-degree connector assembly).

Due to packaging considerations and space constraints, it is important to minimize the size of these connector assemblies, and in particular, their profile or stand-off height from a mounting surface of the header. Achieving a low profile or low overall height, however, typically reduces retention forces between respective mated connectors, in part due to their minimal engagement length and associated reduction in engagement friction. As a result, headers typically utilize four-sided shrouds for increasing mating connector stability and retention, and/or supplemental locking features such as locking levers. However, these features add additional size, especially height, complexity and/or cost to the assemblies.

Accordingly, there is a need for improved electrical connector assemblies that remain compact, while providing sufficient stability and retention force without the need for complex locking provisions of the use of enclosed shrouds.

SUMMARY

An electrical header according to an embodiment of the present disclosure comprises a base for mounting to an object, such as a housing of an electronic device. A shroud extends from the base and is adapted to at least partially receive a mating connector in a mating direction. The shroud includes at least one sidewall defining two free ends. The free ends of the at least one sidewall are receivable within corresponding openings of the mating connector for mechanically joining the two free ends of the at least one sidewall.

According to another embodiment of the present disclosure, an electrical connector assembly includes a header and a corresponding mating connector. The header comprises a base having first and second sidewalls extending therefrom and defining an opening. The mating connector includes a mating end receivable within the opening in a mating direction. In a mated state of the connectors, first and second covers or covered channels of the mating connector receive respective first and second ends of the first and second sidewalls for securing the mating connector to the header.

In another embodiment of the present disclosure, an electrical connector assembly includes a first electrical connector or header having a base and a shroud extending therefrom. The shroud defines a first opening arranged opposite the base and a second lateral opening. The shroud includes free end portions defining the second lateral opening and extend, for example, in an angled manner relative to portions of the shroud immediately adjacent thereto. A second or mating connector of the assembly includes a mating end received within the first opening of the shroud in an insertion direction. A body of the second electrical connector is received within the second lateral opening of the shroud and includes a pair of hoods or covers for engaging with and covering the free ends of the shroud.

BRIEF DESCRIPTION OF THE DRAWINGS

The invention will now be described by way of example with reference to the accompanying Figures, of which.

and

Figure 1:
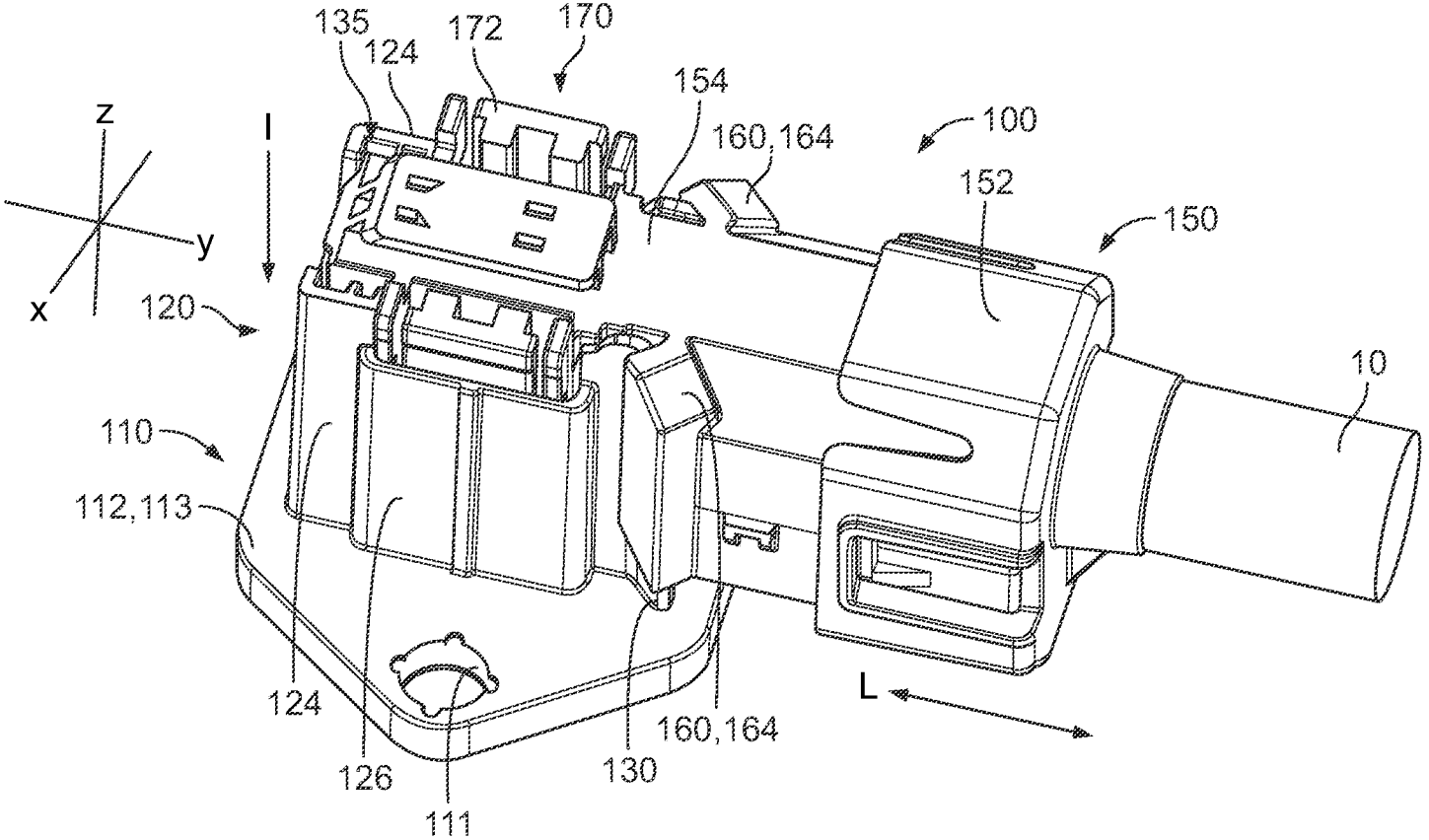
FIG. 1 is a perspective view of an electrical connector assembly including a header and a mating connector according to an embodiment of the present disclosure.
Figure 4:
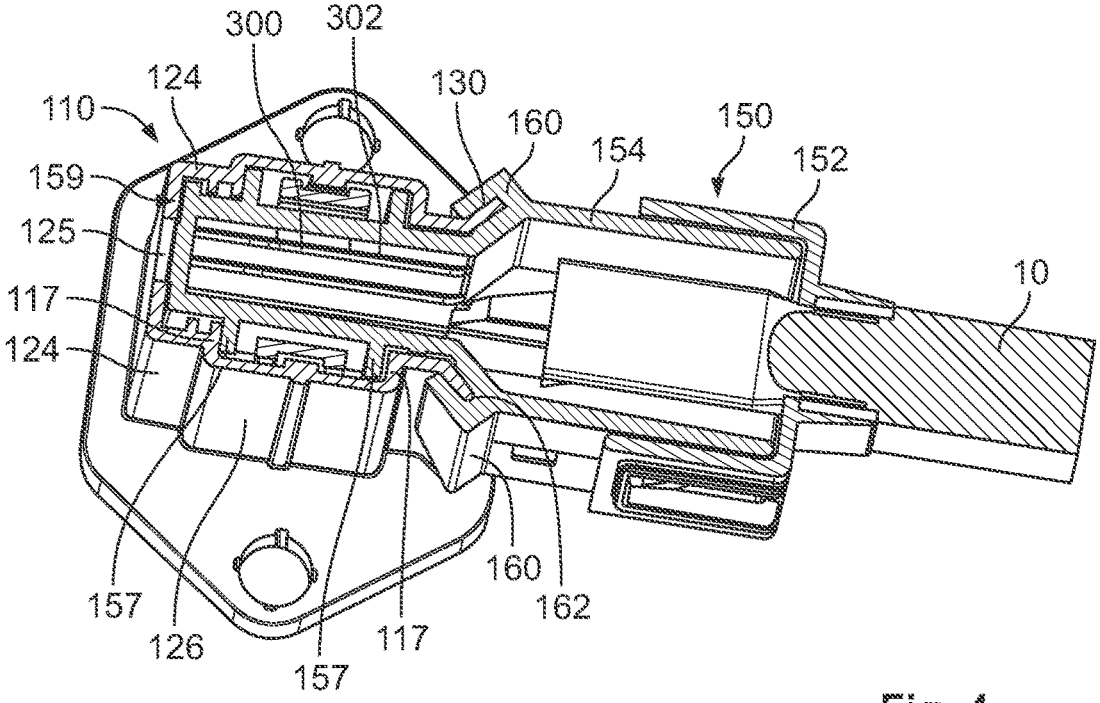

FIG. 4 is a cross-sectional view of the electrical connector assembly of FIG. 1.

DETAILED DESCRIPTION OF THE EMBODIMENTS

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Embodiments of the present disclosure include a low-profile, angled (e.g., right-angle) connector assembly including a header and a corresponding mating connector mateable thereto. The header defines a shroud for receiving a mating end of the mating connector. The shroud is defined by a generally three-sided wall or structure, having a vertical opening for receiving the mating end in an insertion direction, and a lateral opening for receiving a body of the mating connector in the mated position. Unlike prior art headers which typically define a shroud with a continuous circumferential wall (e.g., a four-sided wall), the three-sided or C-shaped shroud or plug according to embodiments of the present disclosure permits the mating end of the second connector to be placed directly adjacent a mounting base of the header, resulting in a low-profile arrangement. The mating connector defines two hoods or covers on respective sides thereof to create improved retention with the three-sided shroud. Specifically, the two hoods engage with and hold sidewall ends of the header shroud in a mated position. In this way, the mating connector joins the free ends of the shroud, and functions as a fourth side of the shroud, creating a robust structure that retains the mating connector with respect to six potential degrees of freedom; three in translation (i.e., along each of the X, Y and Z-axes of FIG. 1) and three axial rotation (i.e., about each of the X, Y and Z-axes) with respect to a center of the header, for example.

Referring generally to FIG. 1, an electrical connector assembly 100 according to an embodiment of the present disclosure includes a first connector or header 110, and a second or mating connector 150 electrically connectable thereto. The header 110 includes a base 112 including an outer mounting flange 113 defining one or more mounting features, such as a plurality of apertures 111 receiving corresponding fasteners for securing the header to a mounting surface, for example, a housing of an electrical component or device. As would be understood by one or ordinary skill, electrical conductors or terminals 300 (see FIG. 4) extend through an opening 135 of the header 110 and comprise first ends for mating with corresponding conductive terminals 302 of the mating connector 150, and second ends for mating with a conductor of the electrical device or component, such as a bus bar arranged within a housing of the device (not shown). The mating connector 150 may be electrically fitted to a free end of one or more conductors or wires 10 to be connected to the electrical component for electrically interconnecting the component to a remainder of an electrical system.

The mating connector 150 comprises a main body 154 defining a mating end 170. The body 154 extends from the cable or wire 10 in a direction L (or along the Y-axis direction), generally parallel to an axial direction of the cable. The mating connector 150 further defines an end cap 152 removably fixed to the main body 154. The mating end 170 of the mating connector 150 is configured to be frictionally-fitted into a shroud 120 of the header 110 in a mating or insertion direction I (or along the Z-axis direction), generally perpendicular to the axial direction of the remainder of the body 154 and/or the cable 10. In this way, the connector assembly 100 according to the exemplary embodiment defines a "right-angle" or 90 degree-type connector. The mating end 170 of the connector 150 includes locking elastic tabs or latches 172 for engaging with a corresponding locking features 119 formed in or on each side of the shroud 120 of the header 110, as will be set forth in greater detail herein.

Figure 3:
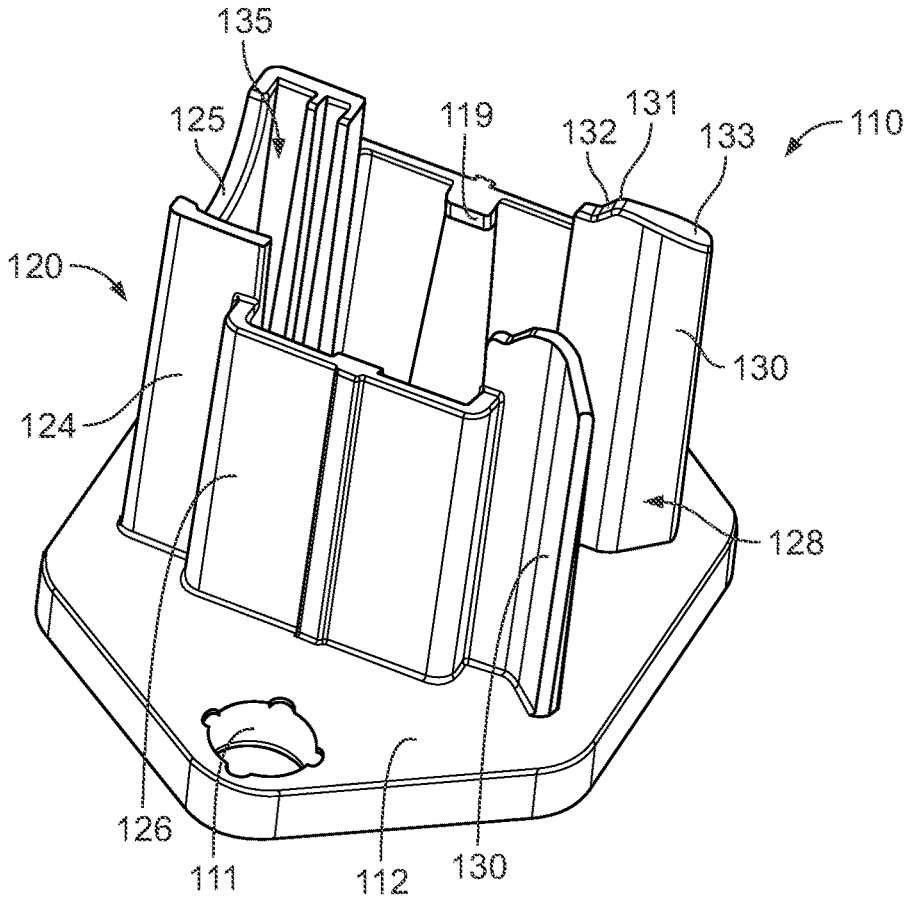
FIG. 3 is a perspective view of the header of the electrical connector assembly of FIG. 1.

With particular reference to FIGS. 1 and 3, the shroud 120 extends from a first side of the base 112 and defines a circumferential wall partially surrounding the opening 135 formed through the header 110 for receiving the mating end 170 of the mating connector 150 in an interior space thereof. The shroud 120 of the exemplary embodiment is a generally three-sided (C-shaped or open-ended) wall including a pair of opposing sidewalls 124 and an end wall 125. Each of the sidewalls 124 may define a receiving slot or slotted opening 126 into which a portion of the mating end 170, for example, a latching portion including latches 172, may be received for engaging with the corresponding locking features 119 of the sidewall 124. Each of the receiving slots 126 of the sidewalls 124 may comprises a height that is less than a height of the remainder of the shroud 120. This reduction in height may be provided to accommodate the latches 172 of the mating end 170, as shown in FIG. 1. The end wall 125 extends generally between, and normal to, the pair of sidewalls 124. An open end 128 is defined by the shroud 120 on a side thereof opposite the end wall 125. The open end 128 is sized to receive the body 154 of the mating connector 150 in the mated position, as shown in FIGS. 1 and 4.

Each sidewall 124 of the shroud 120 further includes an end portion 130 arranged opposite the end wall 125 and defining the open end 128. In one embodiment, each end portion 130 may extend from one of the sidewalls 124 in an oblique or angled manner with respect to a segment of the sidewall 124 immediately adjacent thereto, or with respect to a general direction of extension of the sidewall 124 along the Y-axis (i.e., the axial direction of the body 154 or cable 10). In this way, each end portion 130 extends in directions along both of the X and Y-axes. The end portions 130 may extend in at least partially-opposite directions, for example, along opposite directions along the X-axis, resulting in the open end 128 increasing in width as it opens toward the exterior of the header 110. In other embodiments, the end portions 130 may extend from a remainder of the sidewalls 124 in a non-angled manner.

As is most clearly shown in FIG. 3, a top or apex 131 of each sidewall 124 may be defined directly adjacent each end portion 130, with each end portion defining a generally declining surface or angular edge segment 133 extending downwardly from the apex 131 to a free or end edge thereof. The apex or vertex 131 extends to a height greater than a height of the remainder of the sidewall 124, or of the shroud 120 in total. The apex or vertex 131 may be realized via a top edge of the sidewall 124 having a curved or rounded profile, or at via a juncture of an inclined angular segment 132 and the segment 133, with the segment 133 extending obliquely from the angular segment 132 in at least two directions.

Figure 2:
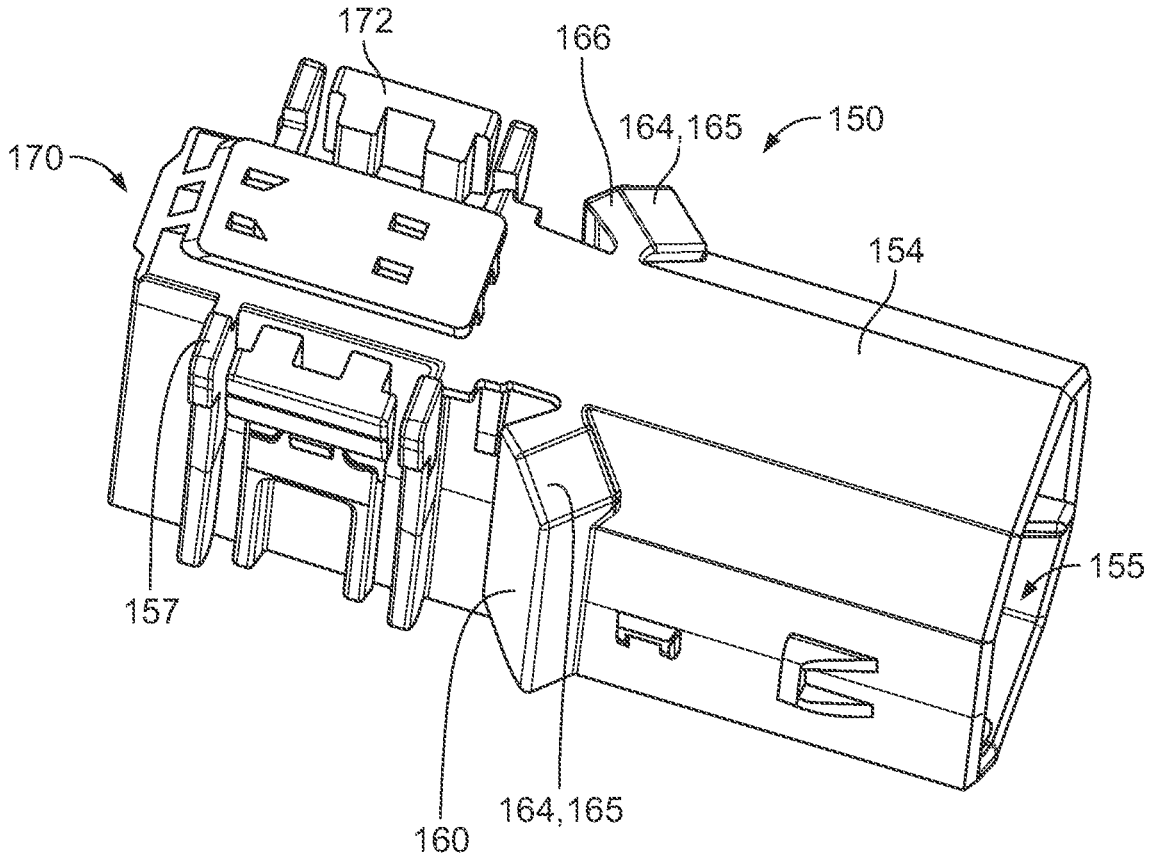
FIG. 2 is a perspective view of the mating connector of the electrical connector assembly of FIG. 1.

As shown in FIGS. 1, 2 and 4, the body 154 of the mating connector 150 defines covers or hoods 160 configured to receive each of the end portions 130 of the shroud 120 therein. Specifically, each cover 160 defines a channel 162 sized and oriented to receive the end portion 130 between opposing walls thereof. In one exemplary embodiment, each cover 160 is sized and located so as to provide a friction or interference fit with the inner and outer-facing surfaces of the end portion 130, aiding in the retention of the mating connector 150 and the header 110. A closed top end 164 of each cover 160 has a profile corresponding to a top edge of the end portion 130, for example, to the angled edge segment 133. Specifically, the top or cover end 164 may comprise a similarly declining segment 165 corresponding to the segment 133, and a second segment 166 extending therefrom obliquely therefrom and corresponding to a remainder of the raised or protruding apex 131 of the sidewall 124. In this way, and as can be visualized from the figures, an interior top end of the channel 162 corresponds in profile to the top edge of the sidewall 124 and/or end portion 130 thereof for achieving abutting engagement therewith over their lengths. In one embodiment, the protruding apex 131 of the sidewall 124 is positioned directly adjacent to an end of the second segment 166 of the cover 160, with the apex extending to a height greater than that of the cover 160 relative to the base 112 of the header 110.

With particular reference to FIG. 4, with the end portions 130 engaged or captured within the corresponding channel 162 of the mating connector 150, the end portions and openings define mating surfaces opposing one another in multiple directions (e.g., the X and Y directions). This arrangement prevents both translation and axial rotation of the header 110 relative to the mating connector 150 in the illustrated mated state with respect to each of the three axes. In this way, the mating connector 150 defines, or functions equivalently to, a fourth sidewall of the shroud by mechanically joining the free end portions 130 of the sidewalls 124 together. As further shown in FIG. 4, the sidewalls 124 and slots 126 of the shroud 120 define opposing interior walls or wall segments 117 configured to frictionally engage with corresponding opposing wall features 157 of the mating end 170 of the mating connector 150 therebetween. Similar opposing or complementary slotted features 159 are defined adjacent the end wall 125.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. An electrical connector assembly comprising:

a first electrical connector including a base and a shroud extending therefrom, the shroud defining a first opening arranged opposite the base and a second lateral opening defined between two ends of the shroud, each of the two ends of the shroud defining a top edge facing opposite the base; and a second electrical connector having a mating end received within the first opening of the shroud, the second electrical connector having a body received within the second lateral opening of the shroud and including a pair of covers for receiving the two ends of the shroud, the pair of covers arranged over and covering the top edge of each end of the shroud.

2. The electrical connector assembly of claim 1, wherein the two ends of the shroud extend obliquely from first and second opposing sidewalls.

3. The electrical connector assembly of claim 2, wherein a width of the second lateral opening increases along a direction from within the shroud toward the second lateral opening.

4. The electrical connector assembly of claim 1, wherein the shroud of the first electrical connector further defines first and second slotted openings arranged on opposite lateral sides of the shroud for engaging with a respective pair of latches of the second connector.

5. The electrical connector assembly of claim 1, wherein the pair of covers of the second electrical connector define first and second channels on opposite lateral sides of the body receiving respective ends of the shroud.

6. The electrical connector assembly of claim 5, wherein each of the two ends of the shroud further define:

oppositely-facing inner and outer surfaces; and an end edge extending perpendicularly from the base, wherein the channel covers the top edge, the oppositely facing surfaces of the sidewall and the end edge.

7. The electrical connector assembly of claim 1, wherein the shroud comprises a three-sided shroud.

8. The electrical connector assembly of claim 7, wherein the shroud comprises a pair of opposing sidewalls extending from the base with each sidewall defining one of the two ends of the shroud, and an end wall extending between the pair of opposing sidewalls on an end opposite the second lateral opening.

9. The electrical connector assembly of claim 8, wherein the second lateral opening is adapted to receive the body of the second electrical connector therethrough.

10. The electrical connector assembly of claim 1, wherein the two ends of the shroud decline in height toward the second lateral opening.

11. The electrical connector assembly of claim 4, wherein the first and second slotted openings defined by the lateral sides of the shroud have a height that is less than a height of a remainder of the shroud, a movable end of each latch is arranged above the first and second slotted openings of the shroud in a direction opposite the base with the first connector mated to the second connector.

12. A connector assembly, comprising:

a header including a base having first and second sidewalls extending therefrom and defining an opening; and a mating connector including a mating end receivable within the opening, and first and second covers receiving respective first and second ends of the first and second sidewalls, each of the first and second ends of the first and second sidewalls defining a top edge facing opposite the base, each top edge covered by a respective one of the first and second covers on a side opposite the base.

13. The connector assembly of claim 12, wherein the header further comprises an end wall extending from the base and joining the first and second sidewalls on respective first ends thereof.

14. The connector assembly of claim 13, wherein the first and second ends of the first and second sidewalls extend obliquely from remaining portions of the first and second sidewalls.

15. The connector assembly of claim 14, wherein the first and second ends of the first and second sidewalls extend in at least partially opposite directions.

16. The connector assembly of claim 12, wherein each cover defines a channel into which the end of each sidewall is received.

17. The connector assembly of claim 16, wherein each channel is closed on an end opposite the base of the header in a mated state of the connector assembly.

18. The connector assembly of claim 17, wherein each of the first and second ends of the first and second sidewalls further defines:

oppositely-facing inner and outer surfaces of the sidewall; and an end edge extending perpendicularly from the base, wherein the cover covers the top edge, the oppositely facing surfaces and the end edge.

19. The connector assembly of claim 12, wherein the top edge of each of the first and second ends defines a declining surface extending obliquely with respect to a vertical direction, and wherein each cover comprises a complementary profile for receiving and covering the declining surface.

20. The connector assembly of claim 19, wherein a top edge of each of the first and second ends defines an inclining surface extending obliquely with respect to the vertical direction, the inclining surface and declining surface joining at an apex having a height relative to the base that is greater than a height of a remainder of the first and second sidewalls, each cover comprising a complementary profile for receiving and covering the entire top edge.

* * * * *